US008856979B2

(12) United States Patent
Matsumoto et al.

(10) Patent No.: US 8,856,979 B2
(45) Date of Patent: Oct. 14, 2014

(54) SANITARY WASHING APPARATUS

(75) Inventors: Satoru Matsumoto, Fukuoka-ken (JP); Koichiro Matsushita, Fukuoka-ken (JP); Aki Hamakita, Fukuoka-ken (JP)

(73) Assignee: Toto Ltd., Kitakyushu-Shi (JP)

( * ) Notice: Subject to any disclaimer, the term of this patent is extended or adjusted under 35 U.S.C. 154(b) by 75 days.

(21) Appl. No.: 13/812,234

(22) PCT Filed: Jul. 27, 2011

(86) PCT No.: PCT/JP2011/067148

§ 371 (c)(1),
(2), (4) Date: Apr. 9, 2013

(87) PCT Pub. No.: WO2012/014947

PCT Pub. Date: Feb. 2, 2012

(65) Prior Publication Data

US 2013/0185861 A1 Jul. 25, 2013

(30) Foreign Application Priority Data

Jul. 28, 2010 (JP) ..... 2010-168749
Mar. 15, 2011 (JP) ..... 2011-056033

(51) Int. Cl.
*A47K 3/022* (2006.01)
*E03D 9/08* (2006.01)

(52) U.S. Cl.
CPC ..... *E03D 9/08* (2013.01)
USPC ..... 4/443

(58) Field of Classification Search
USPC ..... 4/300–442
See application file for complete search history.

(56) References Cited

U.S. PATENT DOCUMENTS

| | | | | |
|---|---|---|---|---|
| 2,051,030 | A * | 8/1936 | Dalinda | 131/330 |
| 3,425,414 | A * | 2/1969 | La Roche | 128/203.21 |
| 4,393,884 | A * | 7/1983 | Jacobs | 131/273 |
| 6,959,708 | B1 * | 11/2005 | Rasor et al. | 128/203.12 |
| 2011/0030133 | A1 * | 2/2011 | Morotomi et al. | 4/443 |
| 2011/0072570 | A1 * | 3/2011 | Morotomi et al. | 4/420.2 |
| 2012/0124730 | A1 * | 5/2012 | Morotomi et al. | 4/443 |
| 2012/0144574 | A1 * | 6/2012 | Morotomi et al. | 4/443 |
| 2013/0185861 | A1 * | 7/2013 | Matsumoto et al. | 4/443 |

FOREIGN PATENT DOCUMENTS

WO WO 2009135729 A1 * 11/2009 ..... A61M 15/06

* cited by examiner

*Primary Examiner* — Lori Baker
(74) *Attorney, Agent, or Firm* — Pearne & Gordon LLP

(57) ABSTRACT

According to an aspect of the invention, a sanitary washing apparatus, characterized by: a nozzle being configured to wash a body of a user by squirting water from a water discharge port; a flow channel configured to guide water supplied from a water supply source toward the water discharge port; an electrolytic cell provided at an intermediate portion of the flow channel, the electrolytic cell being capable of producing sterilizing water; and a nozzle wash unit configured to wash or sterilize the nozzle with the sterilizing water produced by the electrolytic cell, a contraction portion being formed downstream from the electrolytic cell, a flow channel cross-sectional area being smaller at the contraction portion than upstream from the electrolytic cell, a strainer being disposed in the flow channel further downstream from the contraction portion. Clogging of the flow channel due to scale can be suppressed.

14 Claims, 9 Drawing Sheets

| COMPOUND | SOLID PHASE | θ /°C / UNITS | 0 | 10 | 20 | 25 | 30 | 40 | 50 | 60 | 80 | 100 |
|---|---|---|---|---|---|---|---|---|---|---|---|---|
| $CaCO_3$ | 0 | s | 1.34 | 1.11 | 0.91 | 0.82 | 0.72 | 0.55 | 0.43 | 0.36 | 0.26 | 0.20 |

FIG. 8

SANITARY WASHING APPARATUS

FIELD

An aspect of the invention generally relates to a sanitary washing apparatus and specifically relates to a sanitary washing apparatus that uses water to wash the "bottom" and the like of a user sitting on a western-style sit-down toilet.

BACKGROUND

A washing nozzle configured to wash the body such as the "bottom" and the like of a user sitting on a toilet seat squirts wash water onto the body in the state in which at least a portion of the washing nozzle is exposed (advanced) outside a casing to which prescribed functional parts such as the washing nozzle, a warm water tank, etc., are mounted. Therefore, there is a risk that liquid waste and/or solid waste may adhere to the washing nozzle. Conversely, there exist sanitary washing apparatuses to rinse away and remove the liquid waste and/or the solid waste adhered to the washing nozzle prior to and after performing the body wash. Thereby, the washing nozzle is kept clean.

However, even in the case where the liquid waste and/or the solid waste adhered to the washing nozzle are rinsed away, there are cases where bacteria propagates on the washing nozzle over time in humid environments such as that of the toilet room. More specifically, there is a risk that, for example, bacteria such as methylobacterium called pink slime and the like and black mold, etc., that occur on the bowl face and the like of the toilet may adhere to the washing nozzle; and the bacteria may propagate on the washing nozzle. Then, for example, in the case where bacteria called biofilms and the like and collections of secretions of the bacteria (slime and black dirt) form due to the propagation of the bacteria, it becomes difficult to remove such biofilms in a normal nozzle wash such as that described above.

Conversely, there is a private part cleansing apparatus in which an electrolytic cell is included as a nozzle wash production unit (Patent Document 1). In the private part cleansing apparatus according to Patent Document 1, in the case where service water is used as the wash water, chlorine included in the service water undergoes a chemical change into hypochlorous acid due to electrolysis and can perform cleaning as an acidic chemical liquid. Therefore, effective cleaning of particularly the dirt due to ammonia, etc., is possible.

In such a case, it is more favorable for the electrolytic cell to be provided at a portion more proximal to the nozzle to efficiently utilize the wash water produced by the electrolytic cell. Therefore, there is a private part cleansing apparatus in which the electrolytic cell is provided in the flow channel downstream of the warm water tank (Patent Document 2). In the private part cleansing apparatus according to the Patent Document 2, electrolyzed water is produced by warm water being electrolyzed inside the electrolytic cell. Then, a nozzle wash unit squirts the warm water as the wash water onto the bottom wash nozzle and the bidet wash nozzle.

However, when the electrolyzed water is produced by the warm water being electrolyzed, calcium carbonate and the like such as so-called "scale," etc., are produced easily. It is problematic when the scale adheres to the electrodes of the electrolytic cell because the production capability of the electrolyzed water decreases.

Conversely, the private part cleansing apparatus according to Patent Document 2 causes the polarity of the voltage applied to the electrodes to reverse to remove the scale. Similarly, there is a control apparatus of an electrolytic cell that includes a polarity switch unit configured to switch the polarities of the anode side and the cathode side of the electrodes of the electrolytic cell (Patent Document 3). According to the private part cleansing apparatus and the control apparatus of the electrolytic cell according to Patent Documents 2 and 3, respectively, the scale that is produced is peeled from the surfaces of the electrodes by the polarity reversal.

However, in a sanitary washing apparatus having a relatively narrow flow channel, there is a risk that the flow channel may clog due to the scale that peels from the electrodes.

CITATION LIST

Patent Literature

[Patent Citation 1] JP 3487447
[Patent Citation 2] JP 2005-155098 A (Kokai)
[Patent Citation 3] JP H10-34156 A (Kokai)

SUMMARY OF INVENTION

Problem to be Solved by the Invention

The invention was made based on the relevant problems and is directed to provide a sanitary washing apparatus that can suppress clogging due to the scale of the flow channel.

Means for Solving the Problem

According to an aspect of the invention, a sanitary washing apparatus, characterized by: a nozzle having a water discharge port, the nozzle being configured to wash a body of a user by squirting water from the water discharge port; a flow channel configured to guide water supplied from a water supply source toward the water discharge port; an electrolytic cell provided at an intermediate portion of the flow channel, the electrolytic cell being capable of producing sterilizing water; and a nozzle wash unit configured to wash or sterilize the nozzle with the sterilizing water produced by the electrolytic cell, a contraction portion being formed downstream from the electrolytic cell, a flow channel cross-sectional area being smaller at the contraction portion than upstream from the electrolytic cell, a strainer being disposed in the flow channel further downstream from the contraction portion.

BRIEF DESCRIPTION OF DRAWINGS

FIG. 8 is a graph showing the change of the dissolution amount of the calcium carbonate based on the temperature change.

DESCRIPTION OF EMBODIMENTS

Figure 1:
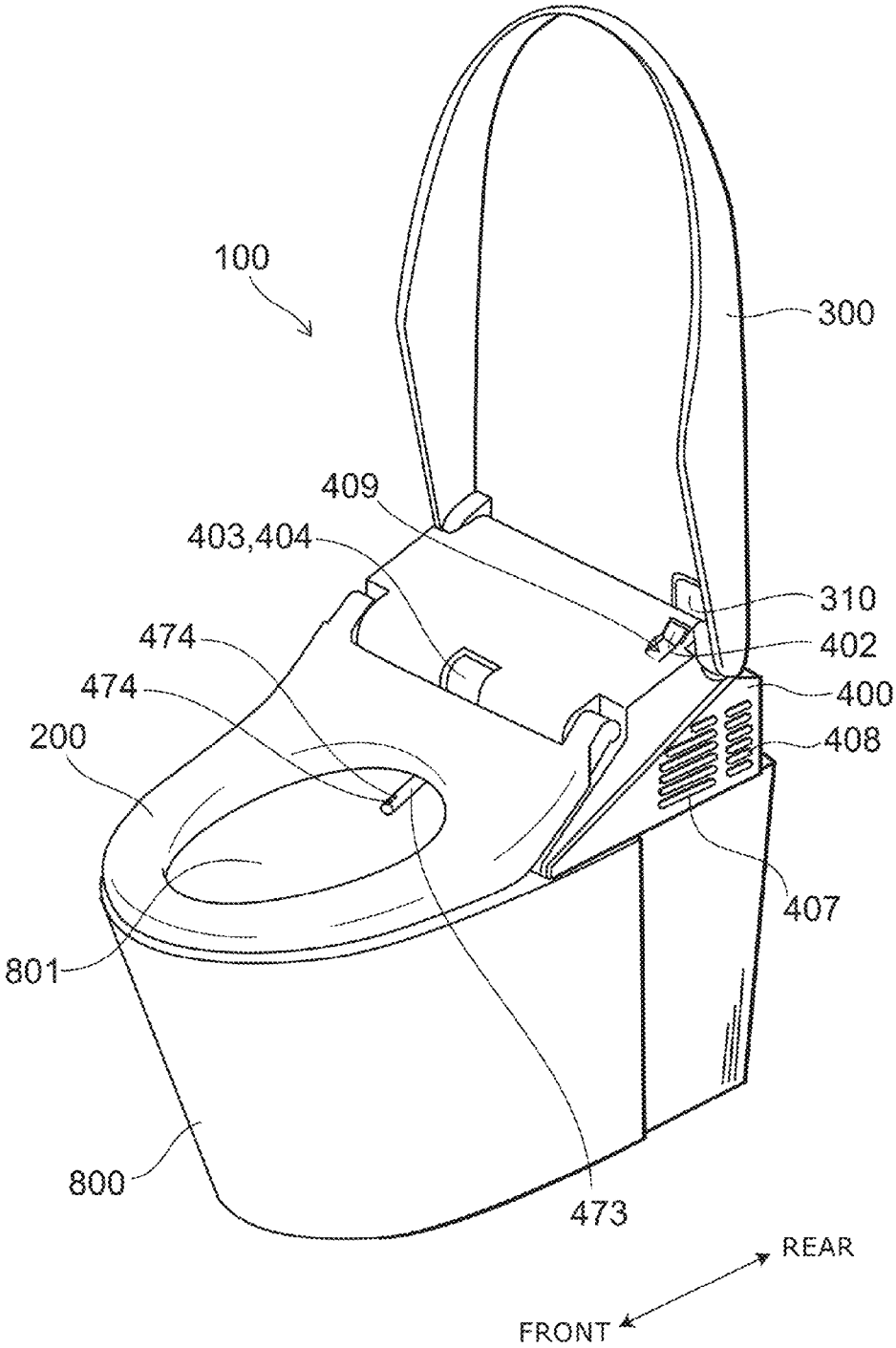
FIG. 1 is a schematic perspective view showing a toilet apparatus including a sanitary washing apparatus according to an embodiment of the invention.

A first invention is a sanitary washing apparatus characterized by: a nozzle having a water discharge port, the nozzle being configured to wash a body of a user by squirting water from the water discharge port; a flow channel configured to guide water supplied from a water supply source toward the water discharge port; an electrolytic cell provided at an intermediate portion of the flow channel, the electrolytic cell being capable of producing sterilizing water; and a nozzle wash unit configured to wash or sterilize the nozzle with the sterilizing water produced by the electrolytic cell, a contraction portion being formed downstream from the electrolytic cell, a flow channel cross-sectional area being smaller at the contraction portion than upstream from the electrolytic cell, a strainer being disposed further downstream from the contraction portion.

According to the sanitary washing apparatus, clogging of the flow channel due to scale downstream from the strainer can be suppressed because the strainer captures, of course, the scale discharged from the electrolytic cell but also captures scale by the contraction portion being formed in a region of unstable electrolyzed water discharged from the electrolytic cell where there is a risk that the scale may precipitate and by the precipitation of the scale and growth of the scale being deliberately induced by turbulence of the flow occurring due to the contraction portion.

Inside the electrolytic cell, although the pH (the "pay-hah") on the cathode side is high due to the electrolysis of the service water and the state at the electrode surface is a state in which the scale forms easily, the state at a water region slightly separated from the electrode surface also is a state in which the pH is high. Although the electrolyzed water discharged from the electrolytic cell flows down the flow channel, the state of the pH is a high and unstable state at the flow region just outside the electrolytic cell; and therefore, it may be conjectured that there is a risk that scale may precipitate and/or small pieces of scale, etc., produced by the electrolytic cell may grow. It may be conjectured that such precipitation and/or growth of the scale occurs due to the flow of the electrolyzed water that flows out from the electrolytic cell becoming turbulent. Therefore, it is possible to suppress unforeseen scale precipitation and growth on the downstream side of the strainer by reducing the diameter of the flow channel, deliberately precipitating the scale at the reduced-diameter portion, and capturing the scale with the strainer.

A second invention is A sanitary washing apparatus, characterized by: a nozzle disposed at a toilet upper portion, the nozzle having a water discharge port, the nozzle being configured to discharge water from the water discharge port toward a bowl face of the toilet; a flow channel configured to guide water supplied from a water supply source toward the water discharge port; an electrolytic cell provided at an intermediate portion of the flow channel, the electrolytic cell being capable of producing sterilizing water; and a bowl wash unit configured to wash or sterilize the bowl face with the sterilizing water produced by the electrolytic cell, a contraction portion being formed downstream from the electrolytic cell, a flow channel cross-sectional area being smaller at the contraction portion than upstream from the electrolytic cell, a strainer being disposed in the flow channel further downstream from the contraction portion.

According to the sanitary washing apparatus, the clogging of the flow channel due to the scale downstream from the strainer can be suppressed because the strainer captures, of course, the scale discharged from the electrolytic cell but also captures scale by the contraction portion being formed in a region of the unstable electrolyzed water discharged from the electrolytic cell where there is a risk that the scale may precipitate and by the precipitation of the scale and growth of the scale being deliberately promoted by the turbulence of the flow occurring due to the contraction portion.

Inside the electrolytic cell, although the pH ("pay-hah") on the cathode side is high due to the electrolysis of the service water and the state at the electrode surface is a state in which the scale forms easily, the state at a water region slightly separated from the electrode surface also is a state in which the pH is high. Although the electrolyzed water discharged from the electrolytic cell flows down the flow channel, the state of the pH is a high and unstable state at the flow region just outside the electrolytic cell; and therefore, it may be conjectured that there is a risk that scale may precipitate and/or small pieces of scale, etc., produced by the electrolytic cell may grow. It may be conjectured that such precipitation and/or growth of the scale occurs due to the flow of the electrolyzed water that flows out from the electrolytic cell becoming turbulent. Therefore, it is possible to suppress unforeseen scale precipitation and growth on the downstream side of the strainer by reducing the diameter of the flow channel, deliberately precipitating the scale at the reduced-diameter portion, and capturing the scale with the strainer.

A third invention is the sanitary washing apparatus of the first invention wherein the contraction portion is formed a prescribed spacing from an outlet unit of the electrolytic cell.

A fourth invention is the sanitary washing apparatus of the second invention wherein the contraction portion is formed a prescribed spacing from an outlet unit of the electrolytic cell.

According to these sanitary washing apparatuses, the outlet unit of the electrolytic cell has a relatively narrow flow channel; therefore, in the case where the contraction portion is formed proximally to the outlet unit, there is a risk that the scale that is precipitated and grown may deposit at the outlet vicinity and lead to clogging of the outlet unit; and therefore, it is possible to effectively capture the scale that is precipitated and grown with the strainer by the contraction portion being a prescribed spacing from the outlet unit; and the clogging of the flow channel can be suppressed.

A fifth invention is the sanitary washing apparatus of the first invention wherein the flow channel on an outlet side of the electrolytic cell is an outlet unit, a diameter of the flow channel being greater at the outlet unit than upstream from the electrolytic cell.

A sixth invention is the sanitary washing apparatus of the second invention wherein the flow channel on an outlet side of the electrolytic cell is an outlet unit, a diameter of the flow channel being greater at the outlet unit than upstream from the electrolytic cell.

According to these sanitary washing apparatuses, it is possible to discharge the unstable electrolyzed water discharged from the electrolytic cell such that the turbulence does not occur as much as possible in the water that flows to the contraction portion formed on the downstream side; and the risk of the clogging at the electrolytic cell outlet unit portion where the flowing water becomes turbulent relatively easily can be suppressed.

A seventh invention is the sanitary washing apparatus of the first invention wherein the strainer is provided attachably and removably.

A eighth invention is the sanitary washing apparatus of the second invention wherein the strainer is provided attachably and removably.

According to these sanitary washing apparatuses, the strainer is attachable and removable; and therefore, the loss of the washing sensation due to the flow rate decrease when washing the body of the user can be suppressed by reducing the flow channel resistance at the strainer by regularly removing the scale that is captured.

A ninth invention is the sanitary washing apparatus of the first invention wherein the strainer is formed of a material having a low surface energy.

A tenth invention is the sanitary washing apparatus of the second invention wherein the strainer is formed of a material having a low surface energy.

According to these sanitary washing apparatuses, the scale particles supplemented by the strainer do not adhere easily; and therefore, the clogging of the strainer due to the particles supplemented by the strainer sticking, the particle growth having the scale particles as nuclei and/or the deposit of the scale particles that subsequently flow by can be prevented as much as possible.

A eleventh invention is the sanitary washing apparatus of the ninth invention wherein the strainer is fixed to a fixing portion of the flow channel, and a surface energy of the fixing portion is greater than the surface energy of the strainer.

A twelfth invention is the sanitary washing apparatus of the tenth invention wherein the strainer is fixed to a fixing portion of the flow channel, and a surface energy of the fixing portion is greater than the surface energy of the strainer.

According to these sanitary washing apparatuses, the scale moves easily toward the fixing portion existing around the strainer and having a surface energy greater than that of the strainer; and therefore, the physical clogging of the central portion of the flow channel also can be suppressed. In particular, in the case where a surface energy high enough for the scale to be adhered is utilized, fine scale can be supplemented around the strainer such that passage through the mesh of the strainer is possible; and therefore, the risk of the fine scale coalescing and enlarging on the downstream side can be suppressed.

A thirteenth invention is the sanitary washing apparatus of the first invention wherein the strainer has a mesh configuration capable of passing particles having no risk of clogging the flow channel downstream.

A fourteenth invention is the sanitary washing apparatus of the second invention wherein the strainer has a mesh configuration capable of passing particles having no risk of clogging the flow channel downstream.

According to these sanitary washing apparatuses, the risk of the strainer being clogged can be suppressed because the particles that do not need to be supplemented by the strainer flow downstream and are discharged.

An embodiment of the invention will now be described with reference to the drawings. In the drawings, similar components are marked with like reference numerals, and a detailed description is omitted as appropriate.

FIG. 1 is a schematic perspective view showing a toilet apparatus including a sanitary washing apparatus according to an embodiment of the invention.

Figure 2:
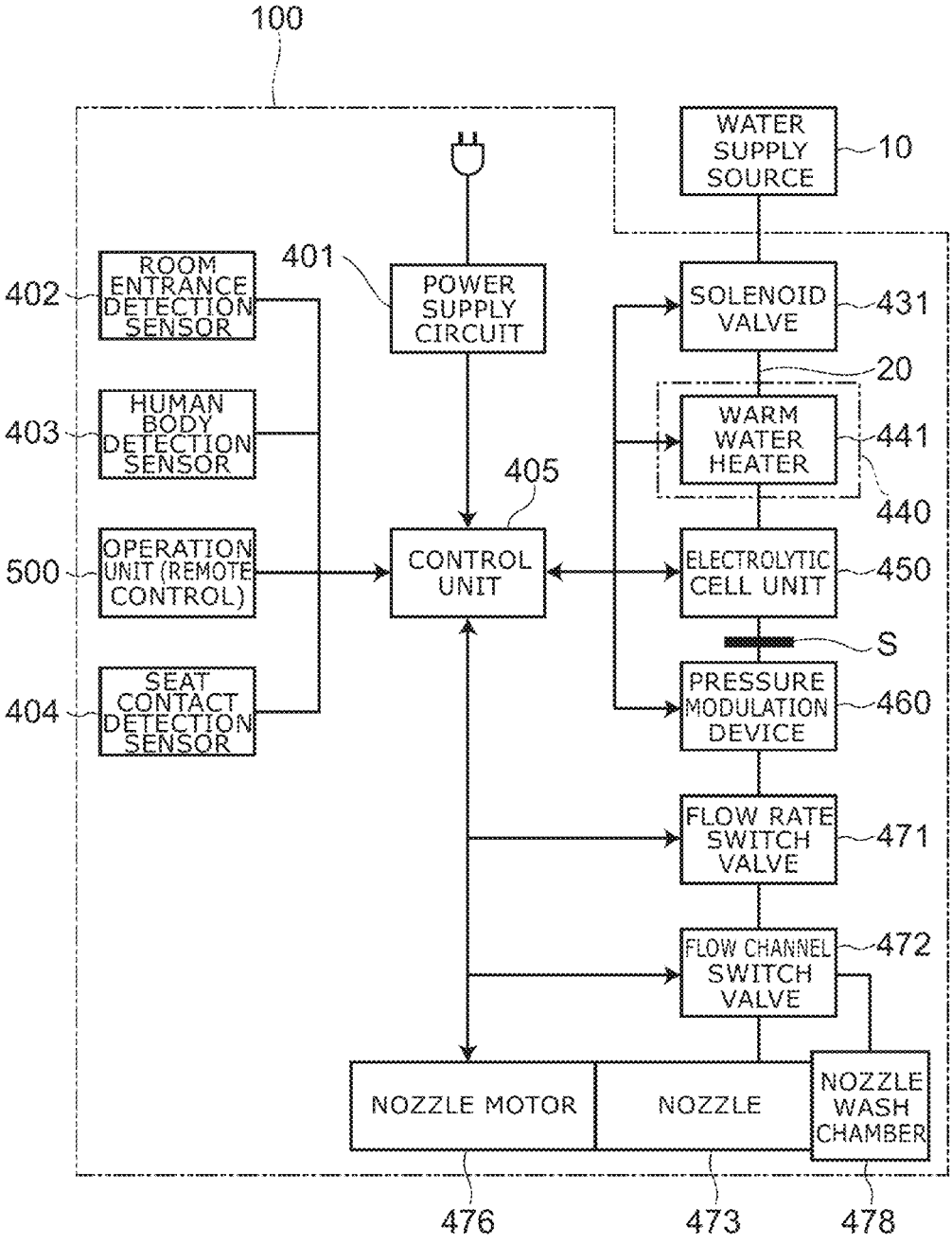
FIG. 2 is a block diagram showing relevant components of the sanitary washing apparatus according to the embodiment.

FIG. 2 is a block diagram showing relevant components of the sanitary washing apparatus according to the embodiment.

FIG. 2 shows the relevant components of both the water channel system and the electrical system.

The toilet apparatus shown in FIG. 1 includes a western-style sit-down toilet (for convenience of description hereinbelow, called simply the "toilet") 800 and a sanitary washing apparatus 100 provided on the western-style sit-down toilet 800. The sanitary washing apparatus 100 includes a casing 400, a toilet seat 200, and a toilet lid 300. The toilet seat 200 is pivotally supported openably and closeably with respect to the casing 400; and the toilet lid 300 is pivotally supported openably and closeably with respect to the casing 400.

A body wash functional unit and the like that realize the washing of a "bottom" and the like of the user sitting on the toilet seat 200 are built into the interior of the casing 400. Also, for example, a seat contact detection sensor (a human body detection unit) 404 configured to detect the user sitting on the toilet seat 200 is provided in the casing 400. In the case where the seat contact detection sensor 404 detects the user sitting on the toilet seat 200, a washing nozzle (for convenience of description hereinbelow, called simply the "nozzle") 473 can be caused to advance into a bowl 801 of the toilet 800 when the user operates, for example, an operation unit 500 such as a remote control, etc. In the sanitary washing apparatus 100 shown in FIG. 1, the nozzle 473 is shown in the state of being advanced into the bowl 801.

One or multiple water discharge ports 474 are provided in the tip portion of the nozzle 473. Then, the nozzle 473 can wash the "bottom" and the like of the user sitting on the toilet seat 200 by squirting water from the water discharge ports 474 provided in the tip portion.

More specifically, the sanitary washing apparatus 100 according to the embodiment includes a flow channel 20 configured to guide water supplied from a water supply source 10 such as a service water line, a water storage tank, etc., to the water discharge ports 474 of the nozzle 473 as shown in FIG. 2. A solenoid valve 431 is provided on the upstream side of the flow channel 20. The solenoid valve 431 is an openable and closable solenoid valve that controls the supply of the water based on a command from a control unit 405 provided in the interior of the casing 400. The flow channel 20 is taken to be the secondary side downstream from the solenoid valve 431.

A heat exchanger unit (a heating unit) 440 is provided downstream of the solenoid valve 431. The heat exchanger unit 440 includes a warm water heater 441. The warm water heater 441 heats the water that is supplied to be the prescribed warm water. A not-shown incoming water thermistor is provided on the upstream side of the warm water heater 441; and a not-shown warm water thermistor is provided on the downstream side of the warm water heater 441. The warm water temperature can be set by, for example, the user operating the operation unit 500.

An electrolytic cell unit (an electrolytic cell) 450 that is capable of producing sterilizing water is provided downstream of the warm water heater 441. The nozzle 473 and the flow channel 20 downstream of the electrolytic cell unit 450 are sterilized by the sterilizing water produced by the electrolytic cell unit 450.

In the flow channel downstream of the electrolytic cell unit 450, a contraction portion that has a smaller flow channel cross-sectional area is formed; and a strainer S is disposed further downstream from the contraction portion. The electrolytic cell unit 450, the reduced-diameter portion, and the strainer S are described below.

A pressure modulation device 460 is provided downstream of the electrolytic cell unit 450. The pressure modulation device 460 can provide a pulsatory motion to the flow of the water inside the flow channel 20 and can provide a pulsatory motion to the water discharged from the water discharge ports 474 of the nozzle 473. However, in the invention, it is not always necessary to provide the pressure modulation device 460.

A flow rate switch valve 471, which adjusts the water force (the flow rate), and a flow channel switch valve 472, which performs the opening and closing and/or the switching of the supply water to the nozzle 473 and/or a nozzle wash chamber (a nozzle wash unit) 478, are provided downstream of the pressure modulation device 460. The flow rate switch valve 471 and the flow channel switch valve 472 may be provided as one unit. Continuing, the nozzle 473 is provided downstream of the flow rate switch valve 471 and the flow channel switch valve 472. A dedicated nozzle configured to discharge the sterilizing water from the flow channel switch valve 472 to the bowl 801 face of the toilet 800 may be formed.

The nozzle 473 can advance and retreat inside the bowl 801 of the toilet 800 by receiving a drive force from a nozzle motor 476. That is, the nozzle motor 476 can cause the nozzle 473 to advance and retreat based on a command from the control unit 405.

Then, the control unit 405 is supplied with electrical power from a power supply circuit 401 and can control the operations of the solenoid valve 431, the warm water heater 441, the electrolytic cell unit 450, the flow rate switch valve 471, the flow channel switch valve 472, and the nozzle motor 476 based on signals from a room entrance detection sensor (a human body detection unit) 402 that detects the user entering the toilet room, a human body detection sensor (a human body detection unit) 403 that detects the user in front of the toilet seat 200, the seat contact detection sensor 404 that detects the user seated on the toilet seat 200, the operation unit 500, etc.

The seat contact detection sensor 404 can detect a user seated on the toilet seat 200 or a human body existing above the toilet seat 200 right before the user is seated on the toilet seat 200. In other words, the seat contact detection sensor 404 can detect not only a user seated on the toilet seat 200 but also a user existing above the toilet seat 200. For example, an infrared transmitting-and-receiving distance sensor and the like can be used as such a seat contact detection sensor 404.

The human body detection sensor 403 can detect the user in front of the toilet 800, that is, the user existing at a position frontward of the toilet seat 200 and distal to the toilet seat 200. That is, the human body detection sensor 403 can detect a user that has entered the toilet room and is approaching the toilet seat 200. For example, an infrared transmitting-and-receiving distance sensor and the like can be used as such a human body detection sensor 403.

The room entrance detection sensor 402 can detect the user directly after opening the door of the toilet room and entering the toilet room or the user existing in front of the door to enter the toilet room. That is, the room entrance detection sensor 402 can detect not only a user that has entered the toilet room but also a user before entering the toilet room, that is, a user existing in front of the door outside the toilet room. A pyroelectric sensor, a microwave sensor such as a doppler sensor, and the like can be used as such a room entrance detection sensor 402. In the case where a sensor utilizing the doppler effect of microwaves, a sensor configured to transmit a microwave and detect the object to be detected based on the amplitude (the strength) of the reflected microwave, or the like is used, it is possible to detect the existence of the user through the door of the toilet room. That is, the user can be detected before entering the toilet room.

In the toilet apparatus shown in FIG. 1, a recessed portion 409 is made in the upper face of the casing 400; and the room entrance detection sensor 402 is provided such that a portion of the room entrance detection sensor 402 is sunk into the recessed portion 409. The room entrance detection sensor 402 detects the room entrance of the user via a transmissive window 310 provided at the base portion vicinity of the toilet lid 300 in the state in which the toilet lid 300 is closed. Then, for example, when the room entrance detection sensor 402 detects the user, the control unit 405 can automatically open the toilet lid 300 based on the detection result of the room entrance detection sensor 402. The seat contact detection sensor 404 and the human body detection sensor 403 are provided at the central portion of the front of the casing 400. However, the disposition methods of the seat contact detection sensor 404, the human body detection sensor 403, and the room entrance detection sensor 402 are not limited thereto and may be modified appropriately.

Various mechanisms such as a "warm air drying function" that dries the "bottom" and the like of the user sitting on the toilet seat 200 by blowing warm air toward the "bottom" and the like of the user, a "deodorizing unit," a "room heating unit," etc., may be appropriately provided in the casing 400. In such a case, an exhaust port 407 from the deodorizing unit and an outlet 408 from the room heating unit may be appropriately provided in the side face of the casing 400. However, in the invention, it is not always necessary to provide sanitary washing functional units and other additional functional units.

Figure 3:
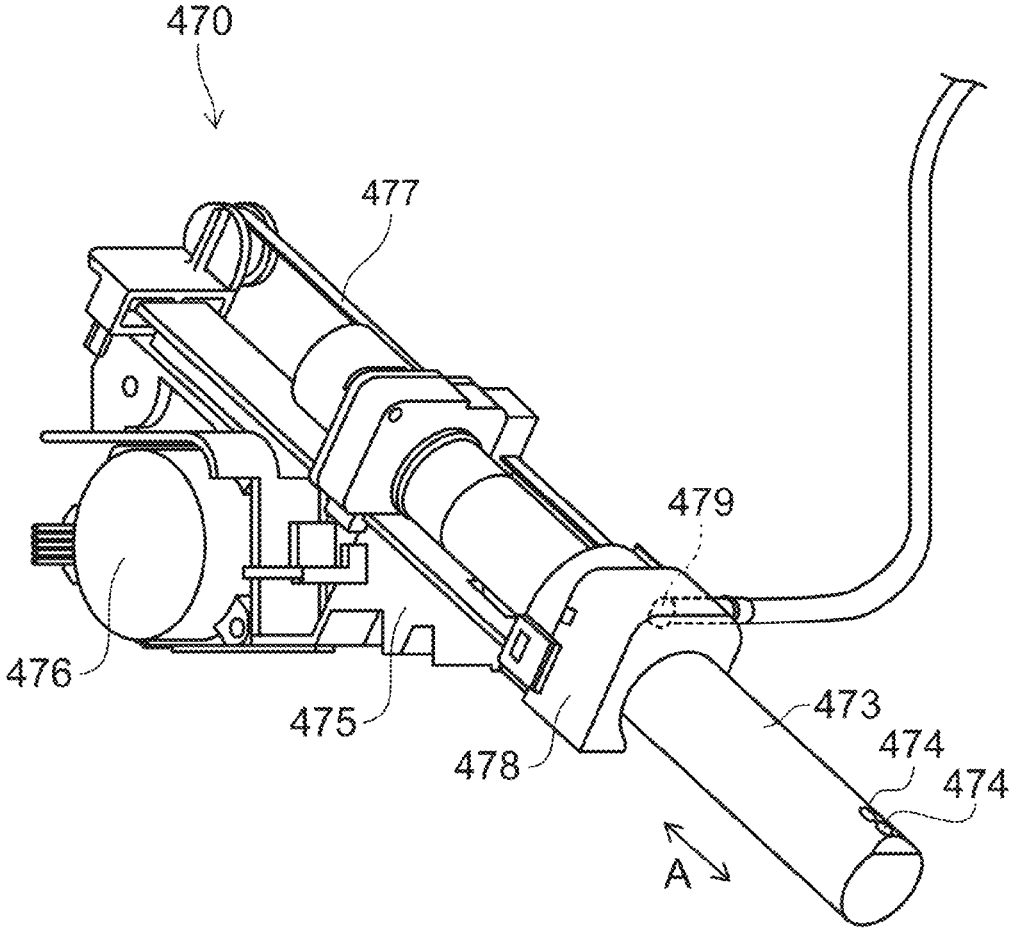
FIG. 3 is a schematic perspective view showing a specific example of a nozzle unit of the embodiment.

FIG. 3 is a schematic perspective view showing a specific example of a nozzle unit of the embodiment.

As shown in FIG. 3, a nozzle unit 470 of the embodiment includes a mount 475 as a base, the nozzle 473 supported by the mount 475, and the nozzle motor 476 configured to move the nozzle 473. As in arrow A shown in FIG. 3, the nozzle 473 is provided slidably with respect to the mount 475 by the drive force transmitted from the nozzle motor 476 via a transmission member 477 such as a belt, etc. In other words, the nozzle 473 can move straight in the axial direction (the advance/retreat direction) of the nozzle 473 itself. Then, the nozzle 473 can move advanceably and retreatably with respect to the casing 400 and the mount 475.

The nozzle wash chamber 478 is provided in the nozzle unit 470 of the embodiment. The nozzle wash chamber 478 is fixed with respect to the mount 475 and can sterilize or wash the outer circumferential surface (the central body) of the nozzle 473 by squirting sterilizing water or water from a water discharge unit 479 provided in the interior of the nozzle wash chamber 478. In other words, in the case where the control unit 405 produces the sterilizing water by providing the current to an anode plate 454 (referring to FIG. 5) and a cathode plate 455 (referring to FIG. 5) of the electrolytic cell unit 450, the central body of the nozzle 473 is sterilized by the sterilizing water squirted from the water discharge unit 479. On the other hand, in the case where the control unit 405 does not provide the current to the anode plate 454 and the cathode plate 455 of the electrolytic cell unit 450, the central body of the nozzle 473 is physically washed by the water squirted from the water discharge unit 479.

More specifically, the portion of the water discharge ports 474 of the nozzle 473 is substantially contained inside the nozzle wash chamber 478 in the state in which the nozzle 473 is stored in the casing 400. Therefore, the nozzle wash chamber 478 can sterilize or wash the portion of the water discharge ports 474 of the nozzle 473 in the stored state by squirting the sterilizing water or the water from the water discharge unit 479 provided in the interior of the nozzle wash chamber 478. Also, the nozzle wash chamber 478 can sterilize or wash not only the portion of the water discharge ports 474 but also the outer circumferential surface of other portions by squirting the water or the sterilizing water from the water discharge unit 479 when the nozzle 473 advance and retreats.

The nozzle 473 of the embodiment can sterilize or wash the portion of the water discharge ports 474 by discharging the sterilizing water or the water from the water discharge ports 474 of the nozzle 473 itself in the state in which the nozzle 473 is stored in the casing 400. Further, the sterilizing water or the water discharged from the water discharge ports 474 of the nozzle 473 comes into contact with the portion of the water discharge ports 474 by being reflected by the inner wall of the nozzle wash chamber 478 because the portion of the water discharge ports 474 of the nozzle 473 is substantially contained inside the nozzle wash chamber 478 in the state in which the nozzle 473 is stored in the casing 400. Therefore, the portion of the water discharge ports 474 of the nozzle 473 is sterilized or washed also by the sterilizing water or the water reflected by the inner wall of the nozzle wash chamber 478.

Figure 4:
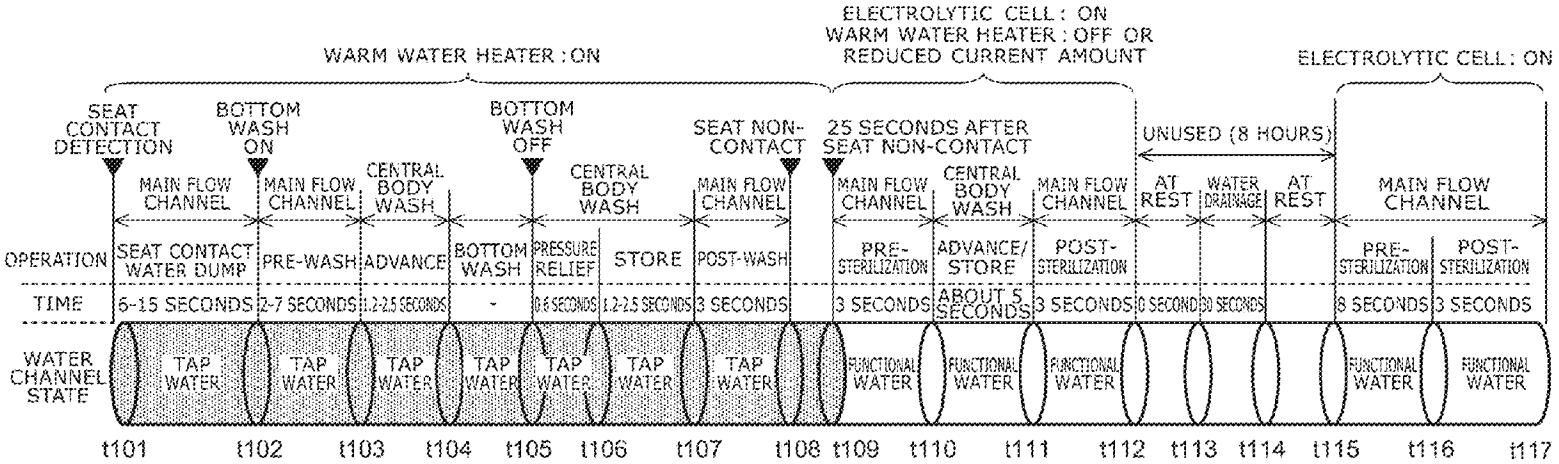
FIG. 4 is a conceptual schematic view showing the schematic of the operations and the state of the flow channel of the sanitary washing apparatus according to the embodiment.

FIG. 4 is a conceptual schematic view showing the schematic of the operations and the state of the flow channel of the sanitary washing apparatus according to the embodiment.

The state of the flow channel shown in FIG. 4 is the state of the interior of the flow channel 20 downstream of the electrolytic cell unit 450.

As described below in regard to FIG. 5, the electrolytic cell unit 450 can electrolyze the service water flowing through the space (the flow channel) between the anode plate 454 and the cathode plate 455 by the control of the flow of current from the control unit 405. The electrolyzed water in the electrolytic cell unit 450 changes into a liquid that includes hypochlorous acid.

Here, the sterilizing water produced in the electrolytic cell unit 450 may be a solution including metal ions such as silver ions, copper ions, etc. Or, the sterilizing water produced in the electrolytic cell unit 450 may be a solution including electrolytic chlorine, ozone, etc. Or, the sterilizing water produced in the electrolytic cell unit 450 may be acidic water or alkaline water. Among these, the solution including hypochlorous acid has a stronger sterilizing power. Hereinbelow, the case where the sterilizing water produced in the electrolytic cell unit 450 is a solution including hypochlorous acid is described as an example.

The hypochlorous acid functions as a sterilizing component; and the solution including the hypochlorous acid, i.e., the sterilizing water, can sterilize by efficiently removing or decomposing dirt due to ammonia and the like. In the specification of the application herein, "sterilizing water" refers to a solution that includes more sterilizing components such as hypochlorous acid and the like than does service water (also referred to as simply "water").

Here, when the electrolytic cell unit 450 electrolyzes the service water to produce the solution including the hypochlorous acid, i.e., the sterilizing water, scale such as calcium carbonate ($CaCO_3$), etc., is produced. The scale is produced by, for example, calcium ions ($Ca^{2+}$) that are dissolved in the water bonding with carbonate ions ($CO_3^{2-}$) that occur from carbonic acid ($H_2CO_3$). In the case where the scale is produced and adheres to the surfaces of the anode plate 454 and the cathode plate 455 of the electrolytic cell unit 450, there is a risk that the production efficiency of the hypochlorous acid may decrease.

As a result of investigations, the inventor discovered that the pH (the "pay-hah:" the hydrogen ion concentration) of the electrolyzed water discharged from the electrolytic cell is in a high state, and scale is produced and grows after the discharge. This is elaborated later.

Because the scale is produced easily as the temperature of the water when the electrolysis is being performed increases, in the embodiment, the control unit 405 executes a control to stop the flow of current to the warm water heater 441 or reduce the current amount to the warm water heater 441 when providing the current to the electrolytic cell unit 450. The schematic of the operations of the sanitary washing apparatus 100 according to the embodiment will now be described with reference to FIG. 4.

First, when the seat contact detection sensor 404 detects the user seated on the toilet seat 200, the control unit 405 opens the solenoid valve 431 to supply the tap water to the flow channel 20 (timing t101). At this time, the sanitary washing apparatus 100 causes the warm water heater 441 to operate. Therefore, the water inside the flow channel 20 is discharged into the toilet 800 bowl 801 and is replaced with the warm water heated by the warm water heater 441. That is, the control unit 405 causes the warm water heater 441 to operate and starts the warm water preparation in which the water is discharged from the water discharge ports 474 (timing U01). The implementation time of the warm water preparation is, for example, about 6 to 15 seconds. In the specification of the application, "tap water" includes not only cold water but also heated warm water.

Continuing, when the user presses a not-shown "bottom wash switch" provided in the operation unit 500 (timing t102), the control unit 405 receives a signal to execute the body wash. Then, the control unit 405 first executes a "pre-wash" using the tap water (timing t102 to t103). More specifically, the control unit 405 discharges the tap water from all of the multiple water discharge ports 474 to wash the water discharge ports 474 by controlling the flow rate switch valve 471 and the flow channel switch valve 472. At this time, the control unit 405 does not provide the current to the electrolytic cell unit 450 and does not cause the electrolytic cell unit 450 to produce the sterilizing water. Therefore, the portion of the multiple water discharge ports 474 is physically washed by the tap water that the water discharge ports 474 themselves discharge (including the tap water reflected by the inner wall of the nozzle wash chamber 478). The implementation time of the pre-wash is, for example, about 2 to 7 seconds.

Then, the control unit 405 causes the nozzle 473 to advance into the bowl 801 while squirting the tap water from the water discharge unit 479 provided in the nozzle wash chamber 478 by controlling the flow rate switch valve 471 and the flow channel switch valve 472. Therefore, the central body of the nozzle 473 is washed with the tap water squirted from the water discharge unit 479 (timing t103 to t104). At this time as well, the control unit 405 does not provide the current to the electrolytic cell unit 450 and does not cause the electrolytic cell unit 450 to produce the sterilizing water. Therefore, the central body of the nozzle 473 is physically washed by the tap water squirted from the water discharge unit 479. The advance time of the nozzle 473 is, for example, about 1.2 to 2.5 seconds.

Continuing, the control unit 405 washes the "bottom" of the user seated on the toilet seat 200 by squirting the tap water from the water discharge ports 474 for the "bottom wash" by controlling the flow rate switch valve 471 and the flow channel switch valve 472 (timing t104 to t105). At this time, the control unit 405 does not provide the current to the electrolytic cell unit 450 and does not cause the electrolytic cell unit 450 to produce the sterilizing water. Therefore, the sterilizing water is not squirted onto the body of the user. Also, because the warm water heater 441 is operated, the body of the user is washed with the warm water heated by the warm water heater 441.

Then, when the user uses the operation unit 500 to press a not-shown "stop switch" (timing t105), the control unit 405 executes a pressure relief control (timing t105 to t106). Then, the control unit 405 stores the nozzle 473 inside the casing 400 while squirting the tap water from the water discharge unit 479 provided in the nozzle wash chamber 478 by controlling the flow rate switch valve 471 and the flow channel switch valve 472 (timing t106 to t107). That is, similarly to when the nozzle advances, the control unit 405 physically washes the central body of the nozzle 473 using the tap water squirted from the water discharge unit 479. The storage time of the nozzle 473 is, for example, about 1.2 to 2.5 seconds.

Continuing, the control unit 405 discharges the tap water from all of the multiple water discharge ports 474 to execute a "post-wash" of the water discharge ports 474 by controlling the flow rate switch valve 471 and the flow channel switch valve 472 in the state in which the nozzle 473 is stored in the casing 400 (timing t107 to U08). At this time, the control unit 405 does not provide the current to the electrolytic cell unit 450 and does not cause the electrolytic cell unit 450 to produce the sterilizing water. Therefore, the portion of the multiple water discharge ports 474 is physically washed by the tap water that the water discharge ports 474 themselves discharge (including the tap water reflected by the inner wall of the nozzle wash chamber 478). The implementation time of the pre-wash is, for example, about 3 seconds.

Then, when a prescribed amount of time (here, for example, about 25 seconds) has elapsed from when the seat contact detection sensor 404 no longer detects the user seated on the toilet seat 200, the control unit 405 starts the flow of current to the electrolytic cell unit 450 and causes the electrolytic cell unit 450 to produce the sterilizing water (timing t109). Also, the control unit 405 stops the flow of current to the warm water heater 441 or reduces the current amount to the warm water heater 441 (timing t109). Here, in the specification of the application, "reducing the current amount" is taken to be the reduction of the current amount such that the temperature of the water heated by the warm water heater 441 is a temperature that is lower than the set value of the warm water temperature when executing the body wash. The set value of the warm water temperature when executing the body wash is, for example, about 30 to 40° C.

When the control unit 405 starts the flow of current to the electrolytic cell unit 450, in the case where there is warm water inside the electrolytic cell unit 450, the control unit 405 starts the flow of current to the electrolytic cell unit 450 after the warm water of the electrolytic cell unit 450 is discharged by the solenoid valve 431 being opened and is replaced with water that is unheated.

Further, the control unit 405 opens the solenoid valve 431 to supply the sterilizing water to the flow channel 20 that is downstream of the electrolytic cell unit 450 (timing t109). Thereby, the flow channel 20 that is downstream of the electrolytic cell unit 450 is sterilized by the sterilizing water. The control unit 405 executes a "pre-sterilization" of the water discharge ports 474 by discharging the sterilizing water from all of the multiple water discharge ports 474 by controlling the flow rate switch valve 471 and the flow channel switch valve 472 (timing t109 to t110). Therefore, the portion of the multiple water discharge ports 474 is sterilized by the sterilizing water that the water discharge ports 474 themselves discharge (including the sterilizing water reflected by the inner wall of the nozzle wash chamber 478). The implementation time of the pre-sterilization is, for example, about 3 seconds.

Continuing, the control unit 405 causes the nozzle 473 to advance into the bowl 801 while squirting the sterilizing water from the water discharge unit 479 provided in the nozzle wash chamber 478 by controlling the flow rate switch valve 471 and the flow channel switch valve 472, and subsequently stores the nozzle 473 in the casing 400 (timing t110 to t111). That is, the control unit 405 performs a "central body wash" of the nozzle 473 using the sterilizing water squirted from the water discharge unit 479 (timing t110 to t111). Thereby, the central body of the nozzle 473 and the interior of the flow channel 20 that is downstream of the electrolytic cell unit 450 are sterilized by the sterilizing water. The implementation time of the central body wash using the sterilizing water is, for example, about 5 seconds.

Then, the control unit 405 discharges the sterilizing water from all of the multiple water discharge ports 474 to execute a "post-sterilization" of the water discharge ports 474 by controlling the flow rate switch valve 471 and the flow channel switch valve 472 in the state in which the nozzle 473 is stored in the casing 400 (timing t111 to t112). Therefore, the portion of the multiple water discharge ports 474 is sterilized by the sterilizing water that the water discharge ports 474 themselves discharge (including the sterilizing water reflected by the inner wall of the nozzle wash chamber 478). The implementation time of the post-sterilization is, for example, about 3 seconds.

Continuing, the control unit 405 closes the solenoid valve 431, subsequently closes the flow channel switch valve 472, and maintains the sterilizing water produced by the electrolytic cell unit 450 in the interior of the flow channel 20 for a prescribed amount of time (timing t112 to t113). Thereby, the interior of the flow channel 20 can be sterilized after the user executes the "bottom wash." Here, the prescribed amount of time is, for example, about 60 minutes. Thus, the sanitary washing apparatus 100 according to the embodiment can more reliably sterilize the bacteria that survives in the interior of the flow channel 20 because the sterilizing water in the interior of the flow channel 20 is maintained for a longer time.

Then, after the prescribed amount of time has elapsed, the control unit 405 performs a "water drainage" (timing t113 to t114). That is, the control unit 405 empties the interior of the flow channel 20 by draining the sterilizing water of the interior of the flow channel 20. The implementation time of the "water drainage" is, for example, about 30 seconds. Thus, the sterilizing water becoming a source of nutrients for the bacteria can be suppressed even in the case where the sterilizing power of the sterilizing water decreases over time because the sanitary washing apparatus 100 according to the embodiment empties the interior of the flow channel 20 by draining the sterilizing water of the interior of the flow channel 20 after maintaining the sterilizing water in the interior of the flow channel 20 for the prescribed amount of time.

Continuing, similarly to the operations relating to timing t112 to t113 described above, the control unit 405 maintains the sterilizing water produced by the electrolytic cell unit 450 in the interior of the flow channel 20 for a prescribed amount of time (timing t114 to t115).

Then, after a prescribed amount of time (here, e.g., about 8 hours) has elapsed from when the sanitary washing apparatus 100 was used last, similarly to the operations relating to timing t109 to t110 and timing t111 to t112 described above, the control unit 405 executes the "pre-sterilization" and the "post-sterilization" (timing t115 to t116 and timing t116 to t117).

When sterilizing the nozzle 473 by starting the flow of current to the electrolytic cell unit 450 to cause the electrolytic cell unit 450 to produce the sterilizing water, the control unit 405 according to the embodiment stops the flow of current to the warm water heater 441 or reduces the current amount to the warm water heater 441. Therefore, the water inside the electrolytic cell unit 450 is water that is unheated when the control unit 405 starts the flow of current to the electrolytic cell unit 450. Or, in the case where there is warm water inside the electrolytic cell unit 450 when the control unit 405 starts the flow of current to the electrolytic cell unit 450, the control unit 405 starts the flow of current to the electrolytic cell unit 450 after replacing the warm water of the electrolytic cell unit 450 with water that is unheated by opening the solenoid valve 431 to discharge the warm water of the electrolytic cell unit 450. Therefore, the warm water inside the electrolytic cell unit 450 is replaced with water that is unheated when the control unit 405 starts the flow of current to the electrolytic cell unit 450. Thereby, the increase of the production of the scale can be suppressed.

There are cases where the control unit 405 provides the current to the warm water heater 441 (performs an ON/OFF control of the warm water heater 441) to increase the water temperature when the water temperature becomes a prescribed temperature (e.g., about 6° C.) or less to prevent the water inside the flow channel 20, the electrolytic cell unit 450, etc., from freezing even in the case where the control unit 405 reduces the current amount to the warm water heater 441. In such a case as well, the current amount for preventing freezing is a current amount such that the temperature of the water heated by the warm water heater 441 is a temperature that is lower than the set value of the warm water temperature when executing the body wash. Therefore, in such a case as well, the increase of the production of the scale can be suppressed. That is, in the specification of the application, "providing the current to the warm water heater 441 when preventing freezing" is included in the scope of "reducing the current amount."

The sterilization is not performed at the temperature of the water for washing the body of the next user after the user has risen from the toilet seat 200 and/or left the toilet room, etc.; and the control unit 405 reduces the current amount of the warm water heater 441 to a current amount such that the temperature of the water heated by the warm water heater 441 is a temperature that is lower than the set value of the warm water temperature when executing the body wash. Therefore, the nozzle 473 can be sterilized using sterilizing water having a temperature that is lower than the set value of the temperature of the water of the body wash. Thereby, the increase of the production of the scale can be suppressed.

After the seat contact detection sensor 404 no longer detects the user seated on the toilet seat 200, the control unit 405 starts the flow of current to the electrolytic cell unit 450 to cause the electrolytic cell unit 450 to produce the sterilizing water. Therefore, it is unnecessary to consider the utilization of the body wash by the user; and it is unnecessary to maintain warm water inside the flow channel 20. Thereby, the control unit 405 can cause the sterilizing water to be produced in the state in which the flow of current to the warm water heater 441 is stopped.

There are cases where the warm water heated by the warm water heater 441 is left inside the flow channel 20 by considering the case where the sanitary washing apparatus 100 is utilized directly after the user has risen from the toilet seat 200. In such a case as well, in the embodiment, the control unit 405 starts the flow of current to the electrolytic cell unit 450 to cause the electrolytic cell unit 450 to produce the sterilizing water after the prescribed amount of time has elapsed from when the seat contact detection sensor 404 no longer detects the user seated on the toilet seat 200. Therefore, the control unit 405 can cause the nozzle 473 to be sterilized after the user has reliably risen from the toilet seat 200.

Although the case where the nozzle 473 is sterilized using the sterilizing water after the seat contact detection sensor 404 no longer detects the user seated on the toilet seat 200 is described as an example in the operations shown in FIG. 4, this is not limited only thereto. The control unit 405 may cause the nozzle 473 to be sterilized with the sterilizing water after the human body detection sensor 403 or the room entrance detection sensor 402 no longer detects the user. In such a case as well, the control unit 405 can stop the flow of current to the warm water heater 441 or reduce the current amount to the warm water heater 441, and cause the electrolytic cell unit 450 to produce the sterilizing water. Then, the increase of the production of the scale can be suppressed.

Figure 5:
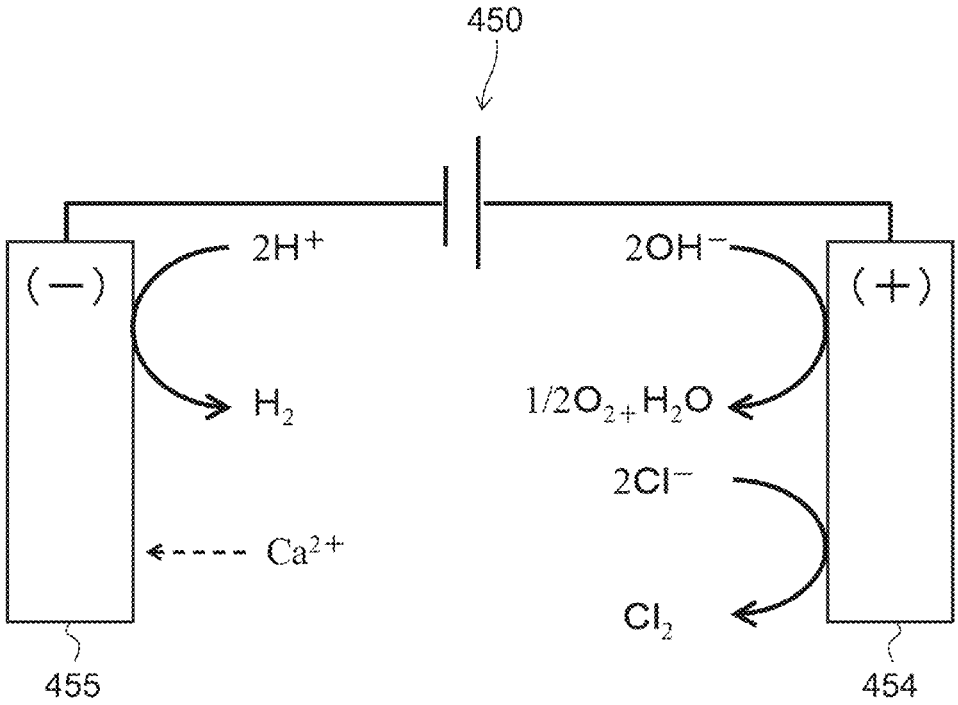
FIG. 5 is a schematic plan view describing the scale produced in the electrolytic cell unit of the embodiment.

FIG. 5 is a schematic plan view describing the scale produced in the electrolytic cell unit of the embodiment.

Figure 6:
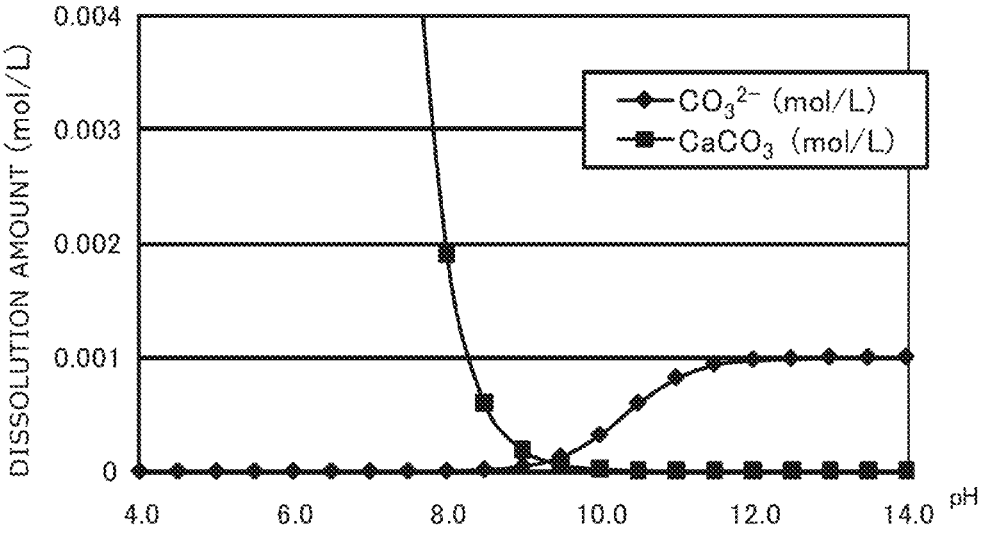
FIG. 6 is a graph showing the change of the dissolution amounts of carbonate ions and calcium carbonate based on the change of the pH.

FIG. 6 is a graph showing the change of the dissolution amounts of carbonate ions ($CO_3^{2-}$) and calcium carbonate ($CaCO_3$) based on the change of the pH.

As shown in FIG. 5, the electrolytic cell unit 450 includes the anode plate 454 and the cathode plate 455 in the interior of the electrolytic cell unit 450 and can electrolyze the service water flowing through the space (the flow channel) between the anode plate 454 and the cathode plate 455 by the control of the flow of current from the control unit 405. At this time, the reaction shown in Formula (1) occurs at the cathode plate 455.

$$H^+ + e^- \rightarrow 1/2H_2\uparrow \quad (1)$$

Therefore, the acid ($H^+$) is consumed at the cathode plate 455; and the pH proximal to the cathode plate 455 increases. When the pH increases, as shown in FIG. 6, the dissolution amount of the carbonate ions ($CO_3^{2-}$) increases. As the pH increases, the carbonic acid ($H_2CO_3$) releases hydrogen ions ($H^+$) and produces carbonate ions ($CO_3^{2-}$); and the reaction shown in Formula (2) occurs. Then, the carbonate ions ($CO_3^{2-}$) that occur bond to the calcium ions ($Ca^{2+}$) existing inside the service water; and the reaction of Formula (3) occurs. That is, as shown in FIG. 6, the increase of the pH causes calcium carbonate ($CaCO_3$: scale) production (precipitation due to the solubility decrease).

$$H_2CO_3 \rightarrow 2H^+ + CO_3^{2-} \quad (2)$$

$$Ca^{2+} + CO_3^{2-} \rightarrow CaCO_3 \quad (3)$$

On the other hand, the reaction shown in Formula (4) occurs at the anode plate 454. The service water includes chlorine ions ($Cl^-$). These chlorine ions are included in water sources (e.g., groundwater, the water of dams, and the water of rivers, etc.) as common salt (NaCl) and calcium chloride ($CaCl_2$). Therefore, the reaction shown in Formula (5) occurs.

$$20H^- \rightarrow 2e^- + H_2O + 1/20_2\uparrow \quad (4)$$

$$Cl^- \rightarrow e^- + 1/2Cl_2 \quad (5)$$

The chlorine that occurs in Formula (5) does not easily exist as bubbles; and almost all of the chlorine dissolves in the water. Therefore, for the chlorine that occurs in Formula (5), the reaction shown in Formula (6) occurs. Thus, hypochlorous acid (HClO) is produced by electrolyzing the chlorine ions. As a result, the electrolyzed water in the electrolytic cell unit 450 changes into a liquid including hypochlorous acid. Because alkali (Oft) is consumed at the anode plate 454, the pH proximal to the anode plate 454 decreases.

$$Cl_2+H_2O \rightarrow HClO+H^++H^++Cl^- \quad (6)$$

Figure 7:
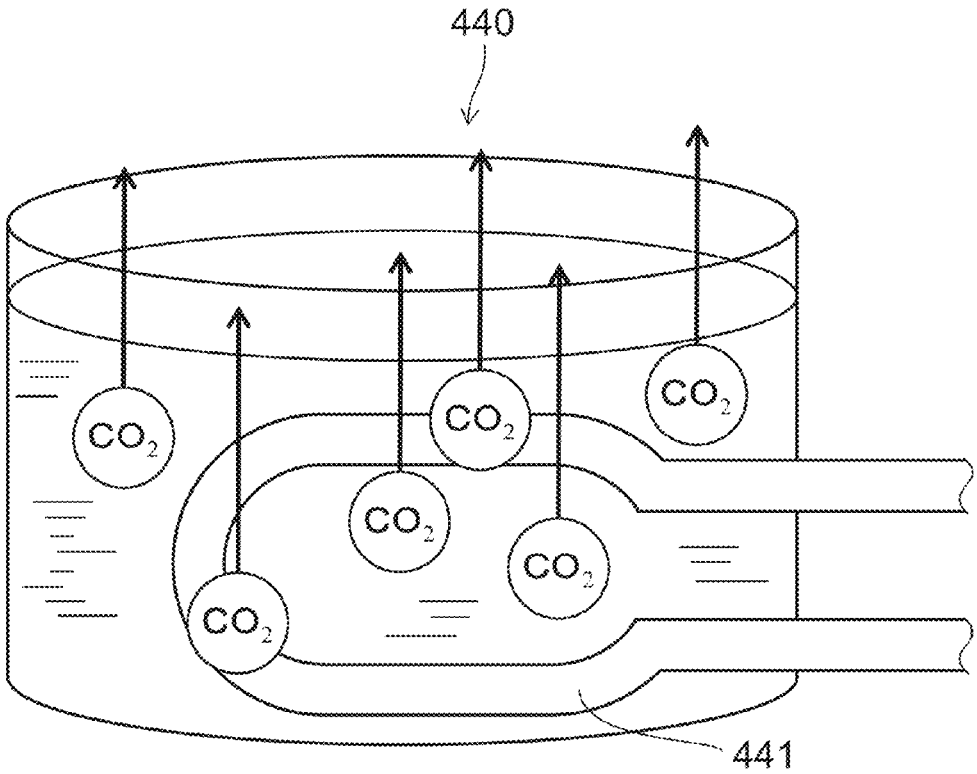
FIG. 7 is a schematic plan view describing the scale produced in the heat exchanger unit of the embodiment.

FIG. 7 is a schematic plan view describing the scale produced in the heat exchanger unit of the embodiment.

FIG. 8 is a graph showing the change of the dissolution amount of the calcium carbonate based on the temperature change.

For example, when the water temperature inside the heat exchanger unit 440 increases due to the control unit 405 starting the flow of current to the electrolytic cell unit 450, the carbonic acid does not easily dissolve in the water and is released into the air as oxygen dioxide ($CO_2$). In such a case, the pH proximal to the warm water heater 441 increases. Therefore, as described above in regard to FIG. 5 and FIG. 6, the scale becomes easy to produce. As shown in FIG. 8, the dissolution amount of the calcium carbonate decreases when the water temperature increases. That is, the calcium carbonate is not dissolved easily in the water when the water temperature increases. Therefore, the scale is produced easily or precipitates easily when the water temperature increases.

This is similar for the electrolytic cell unit 450 as well as the heat exchanger unit 440. That is, in the case where the water having a higher temperature is supplied to the electrolytic cell unit 450 and the electrolytic cell unit 450 electrolyzes the water having the higher temperature, the scale is produced easily or precipitates easily.

Thus, when the temperature of the water increases, the scale becomes easy to produce at the electrolytic cell unit 450 and the heat exchanger unit 440. Therefore, to suppress the increase of the production of the scale and suppress the decrease of the production efficiency of the hypochlorous acid, it is necessary to suppress the increase of the production of the scale in the electrolytic cell unit 450 and the heat exchanger unit 440.

Conversely, according to the embodiment, the control unit 405 stops the flow of current to the warm water heater 441 or reduces the current amount to the warm water heater 441 when starting the flow of current to the electrolytic cell unit 450. Therefore, the increase of the temperature of the water inside the electrolytic cell unit 450 and the heat exchanger unit 440 can be suppressed when the electrolytic cell unit 450 produces the sterilizing water. Thereby, the increase of the production of the scale in the electrolytic cell unit 450 and the heat exchanger unit 440 can be suppressed.

The scale production from the electrolyzed water that is electrolyzed by the electrolytic cell unit 450 and discharged from the electrolytic cell, and the strainer S that captures the scale will now be described based on FIG. 9.

Figure 9:
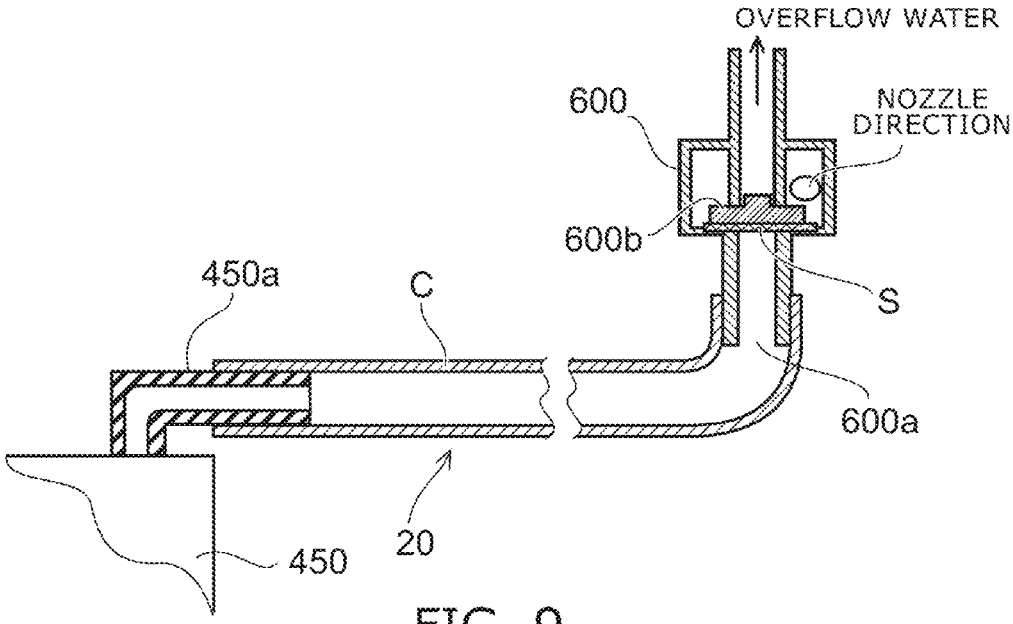
FIG. 9 is a schematic view showing the flow channel downstream from the electrolytic cell.

FIG. 9 is a schematic view showing the flow channel downstream from the electrolytic cell.

In FIG. 9, a flexible tube C such as a silicone tube, etc., is fitted around and connected to an outlet unit 450*a* of the electrolytic cell unit 450. The reference numeral 600 is a vacuum breaker provided such that the water of the downstream side does not flow backward toward the upstream side; and the flexible tube C is fitted around and connected to a connection portion 600*a* of the vacuum breaker. Because the inner diameter of the connection portion 600*a* (the contraction portion) is a diameter that is smaller than the flexible tube inner diameter, the flow channel resistance is higher at the connection portion 600*a* than upstream; and turbulence of the flow occurs. Further, the strainer S and a float valve 600*b* are disposed on the downstream side of the connection portion 600*a*; and the downstream side of the connection portion 600*a* branches into the flow channel 20 toward the nozzle 473 and into a discharge flow channel that discharges the overflow water of the vacuum breaker. The discharge flow channel discharges into the bowl of the toilet.

The operations of the embodiment will now be described.

For the electrolyzed water that is electrolyzed by the electrolytic cell unit 450 and discharged from the electrolytic cell unit 450, the pH increases on the cathode side and the pH decreases on the anode side inside the electrolytic cell unit 450 as described above. Thus, although the pH inside the electrolytic cell unit is in an unbalanced state, the electrolyzed water discharged from the electrolytic cell unit 450 is still in the unbalanced state. The state directly after being discharged from the electrolytic cell unit 450 is almost always a state in which the pH is high (the pH is about 10). Although the electrolyzed water having the high pH reaches the vacuum breaker 600 by passing through the flexible tube C, the electrolyzed water inside the flexible tube C maintains the unbalanced state and remains substantially in the state of the pH discharged from the electrolytic cell unit 450 without flow channel resistance. As shown in FIG. 6, the state in which the pH is high is suitable as the condition at which the scale is produced.

The flow of the electrolyzed water having the high pH is subjected to flow channel resistance at the connection portion 600*a* (the contraction portion) of the vacuum breaker 600 that has the diameter that is smaller than the inner diameter of the flexible tube C; and the electrolyzed water is mixed. Thereby, the carbonate ions ($CO_3^{2-}$) that were dissolved bond easily to the calcium ions ($Ca^{2+}$) existing inside the service water; and the reaction of Formula (3) recited above occurs. As the reaction of Formula (3) progresses, the growth of the scale having the micro scale pieces that were suspended in the electrolyzed water as nuclei is promoted; and the scale occurs at the connection portion 600*a* vicinity. It is considered that the micro scale pieces occur when reversing the polarities of the electrodes of the electrolytic cell unit 450 and are discharged from the electrolytic cell unit 450.

Although the scale that is produced and the electrolyzed water flow downstream, the strainer S is disposed further downstream of the connection portion 600*a*; and therefore, the scale that is produced is captured by the strainer S. The unbalanced state of the pH is eliminated by using the connection portion 600*a* to cause flow channel resistance to occur to mix the electrolyzed water; and therefore, the pH of the downstream side of the strainer S becomes low; and the production of the scale is suppressed. Therefore, the scale clogging can be suppressed at the pressure modulation device, the flow channel switch valve, and the nozzle that are disposed downstream of the vacuum breaker 600 and for which the flow channel has a reduced diameter. Of course, relatively large scale pieces that are discharged from the electrolytic cell unit 450 also are capturable at the strainer S.

It is desirable for the position of the strainer S to be proximal to the downstream side of the connection portion 600*a* where the mixing is sufficiently performed and the unbalanced pH subsides. In the case where the strainer S is disposed inside the flow channel where the pH is in the unbalanced state, there is a risk that the scale may be produced on the downstream side of the strainer S; and sufficient effects cannot be expected.

As the strainer S recited above, a strainer having a mesh configuration formed of a metal such as stainless steel, etc., and/or a resin can be favorably utilized. Although the size of the mesh is appropriately set by considering the flow channel resistance and the size of the scale to be captured such that the clogging of the flow channel on the downstream side can be avoided, about 18 to 80 mesh can be favorably utilized.

For the strainer S, a material having a small surface energy, particularly a fluorocarbon resin, a silicone resin, polypropylene, polyethylene, polystyrene, etc., is desirable. The scale pieces do not easily stick to the strainer S that includes the material having the small surface energy. Therefore, it is desirable because the scale pieces that are smaller than the mesh size are not supplemented by the strainer S and flow toward the downstream side; and therefore, the clogging of the strainer due to the scale can be prevented as much as possible. In particular, many of the scale pieces that occur when deliberately precipitating the scale and growing the scale by the contraction portion have a small size. Therefore, the clogging due to the small scale pieces sticking and gradually growing can be effectively avoided. Also, because the scale pieces that are larger than the mesh size do not easily stick to the strainer, these scale pieces do not easily become starting points of the growth of the scale. Therefore, similarly, the clogging of the strainer due to the scale can be suppressed.

Figure 10:
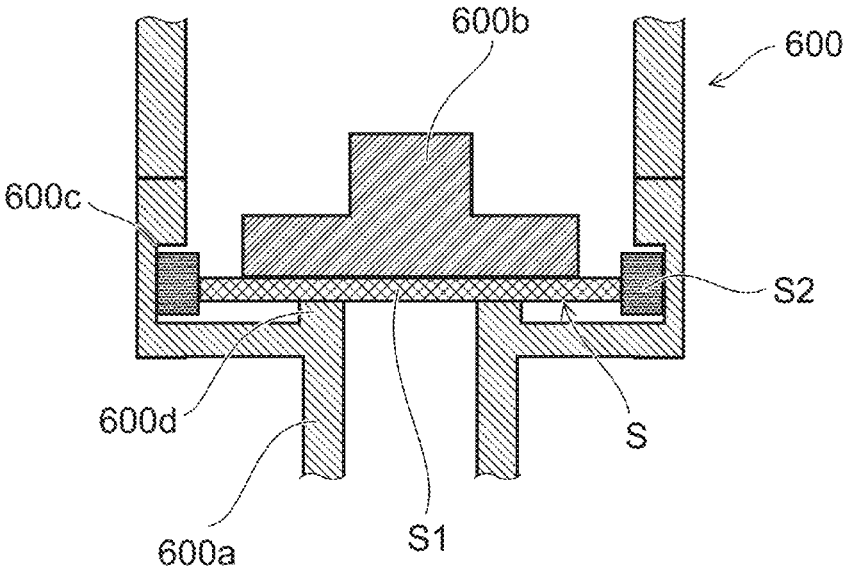
FIG. 10 is a schematic partially enlarged view of FIG. 9.

FIG. 10 is a schematic partially enlarged view of FIG. 9 and describes the fixed state of the strainer S. The strainer S includes the mesh portion of a resin S1 and a fixing edge portion S2. The fixing edge portion S2 is disposed on a strainer fixing portion 600*c* and a support portion 600*d* formed in the inner wall of the vacuum breaker 600 so as not to move by the water pressure of the upstream side. For the strainer that is fixed, because the surface energy of the mesh portion S1 is smaller than that of the material of the vacuum breaker 600 and smaller than that of the fixing edge portion S2 of the strainer S, the scale that does not pass through the mesh tends to move outward from the center of the strainer S (the strainer fixing portion 600*c* and support portion 600*d* directions). Therefore, it is possible to suppress the flow channel resistance of the strainer S as much as possible.

When disposing the strainer S, the strainer S may be attachable and removable such that the scale that is captured can be cleaned regularly.

There is a possibility that the production of the scale and clogging may be caused at the flow channel of the outlet unit 450*a* because flow channel resistance easily occurs by the flow channel being bent or the flow channel diameter decreasing. Therefore, the inner diameter of the flow channel is larger at the outlet unit 450*a* than upstream of the outlet unit 450*a* to suppress the flow channel resistance at the outlet unit 450*a* vicinity as much as possible; and thereby, the production of the scale is deliberately induced at the contraction portion formed downstream of the outlet unit 450*a*; and the production of unforeseen scale from the electrolyzed water that flows downstream can be suppressed.

Figure 11:
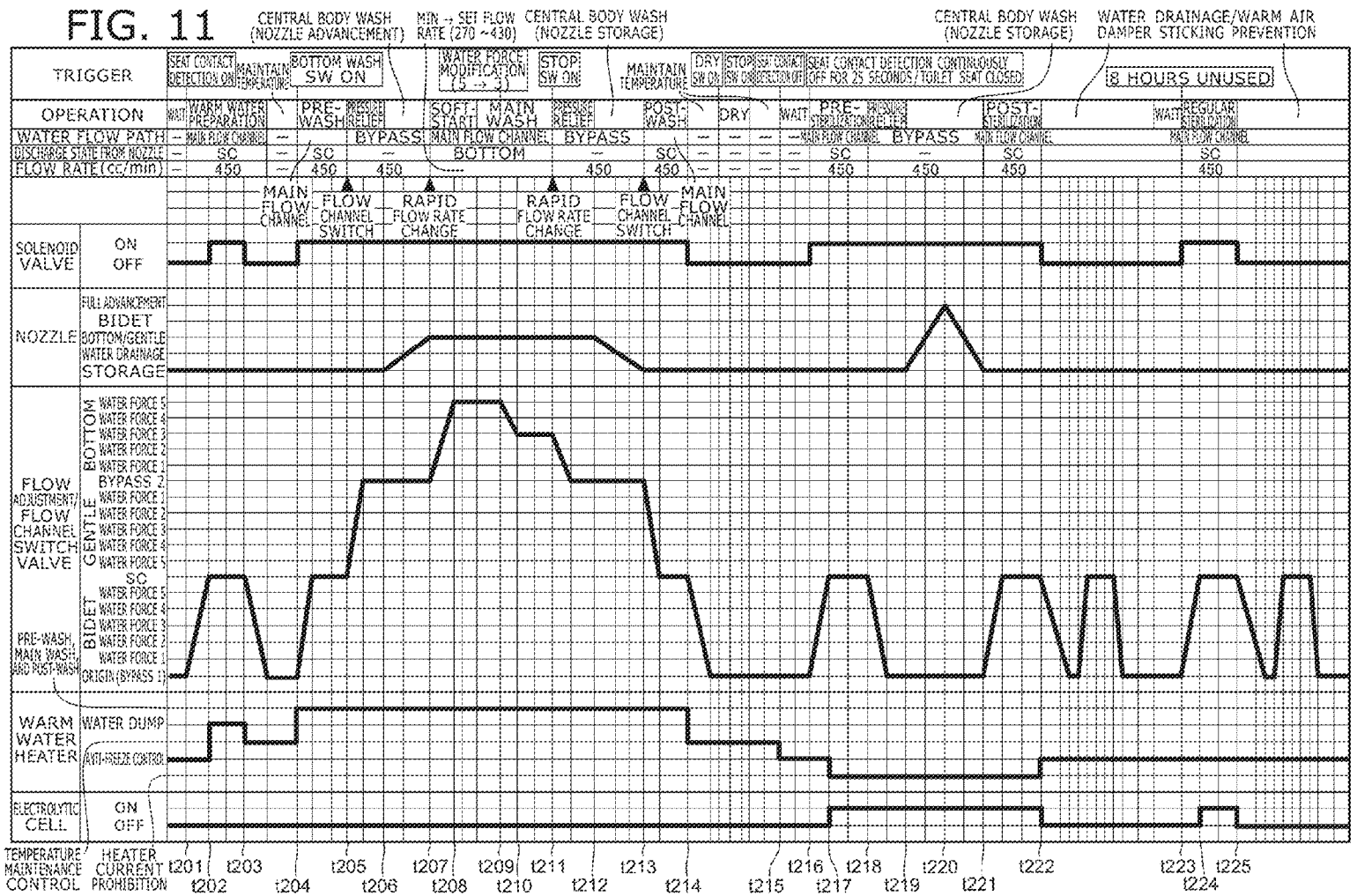
FIG. 11 is a tinning chart showing a specific example of the operations of the sanitary washing apparatus according to the embodiment.

FIG. 11 is a timing chart showing a specific example of the operations of the sanitary washing apparatus according to the embodiment.

First, when the seat contact detection sensor 404 detects the user seated on the toilet seat 200 (timing t201), the control unit 405 switches the flow rate switch valve 471 and the flow channel switch valve 472 from the "origin" to "SC (self-cleaning)" and makes it possible to discharge from all of the water discharge ports 474 for the "bottom wash" and the "bidet wash." The flow rate (the water amount) at this time is, for example, about 450 cc/minute.

Continuing, when the switching of the flow rate switch valve 471 and the flow channel switch valve 472 is completed (timing t202), the control unit 405 opens the solenoid valve 431 and sets the warm water heater 441 to a "water dump mode." Thereby, the cold water inside the flow channel 20 is drained; and the warm water preparation is performed again. Then, when the warm water preparation is completed, the control unit 405 closes the solenoid valve 431 and switches the flow rate switch valve 471 and the flow channel switch valve 472 from "SC" to the "origin (bypass 1)" (timing t203). Further, the control unit 405 performs a setting modification of the warm water heater 441 from the "water dump mode" to a "temperature maintenance control mode" (timing t203).

Then, when the user presses a not-shown "bottom wash switch" provided in the operation unit 500 (timing t204), the control unit 405 receives a signal to execute the body wash. Then, the control unit 405 switches the flow rate switch valve 471 and the flow channel switch valve 472 from the "origin" to "SC," opens the solenoid valve 431, and sets the warm water heater 441 to the "pre-wash mode, the main wash mode, and the post-wash mode."

At this time, the control unit 405 does not provide the current to the electrolytic cell unit 450 and does not cause the electrolytic cell unit 450 to produce the sterilizing water. Also, the control unit 405 causes the warm water heater 441 to heat the water by setting the warm water heater 441 to the "pre-wash mode, the main wash mode, and the post-wash mode." Therefore, the portion of the water discharge ports 474 is washed by the warm water that the water discharge ports 474 themselves discharge.

Continuing, the control unit 405 switches the flow rate switch valve 471 and the flow channel switch valve 472 from "SC" to "bypass 2" and makes it possible to squirt the water from the water discharge unit 479 provided in the nozzle wash chamber 478 (timing t205). Continuing, the control unit 405 causes the nozzle 473 stored in the casing 400 to advance to the position of the "bottom wash" (timing t206 to t207).

The solenoid valve 431 is opened by the control unit 405; and the control unit 405 does not provide the current to the electrolytic cell unit 450 and does not cause the electrolytic cell unit 450 to produce the sterilizing water. Also, the control unit 405 causes the warm water heater 441 to heat the water by setting the warm water heater 441 to the "pre-wash mode, the main wash mode, and the post-wash mode." Therefore, the central body of the nozzle 473 is washed by the warm water squirted from the water discharge unit 479.

Then, the control unit 405 switches the flow rate switch valve 471 and the flow channel switch valve 472 from "bypass 2" to "bottom water force 5" (timing t207 to t208) and executes the main wash (the bottom wash) (timing t208 to t209). For example, in the case where the user uses the operation unit 500 to perform a setting modification of the water force of the "bottom wash" from "water force 5" to "water force 3," the control unit 405 switches the flow rate switch valve 471 and the flow channel switch valve 472 from "bottom water force 5" to "bottom water force 3" (timing t209 to t210). Then, the control unit 405 continues the main wash at "water force 3" (timing t210 to t211).

In the main wash, the control unit 405 does not provide the current to the electrolytic cell unit 450 and does not cause the electrolytic cell unit 450 to produce the sterilizing water. Therefore, the sterilizing water is not squirted onto the body of the user. Because the warm water heater 441 is set to the "pre-wash mode, the main wash mode, and the post-wash mode," the body of the user is washed by the warm water heated by the warm water heater 441.

Continuing, when the user uses the operation unit 500 to press a not-shown "stop switch," the control unit 405 switches the flow rate switch valve 471 and the flow channel switch valve 472 from "bottom water force 3" to "bypass 2" and makes it possible to squirt the water from the water discharge unit 479 provided in the nozzle wash chamber 478 (timing t211). Continuing, the control unit 405 stores the nozzle 473 which had advanced to the position of the "bottom wash" in the casing 400 (timing t212 to t213).

At this time, the solenoid valve 431 is opened by the control unit 405; and the control unit 405 does not provide the current to the electrolytic cell unit 450 and does not cause the electrolytic cell unit 450 to produce the sterilizing water. The control unit 405 causes the warm water heater 441 to heat the water by setting the warm water heater 441 to the "pre-wash mode, the main wash mode, and the post-wash mode." Therefore, the central body of the nozzle 473 is washed by the warm water water squirted from the water discharge unit 479.

Continuing, in the state in which the nozzle 473 is stored in the casing 400, the control unit 405 switches the flow rate switch valve 471 and the flow channel switch valve 472 from "bypass 2" to "SC" and performs the post-wash by discharging from all of the water discharge ports 474 for the "bottom wash" and the "bidet wash" (timing t213 to t214).

At this time as well, the solenoid valve 431 is opened by the control unit 405; and the control unit 405 does not provide the current to the electrolytic cell unit 450 and does not cause the electrolytic cell unit 450 to produce the sterilizing water. The control unit 405 causes the warm water heater 441 to heat the water by setting the warm water heater 441 to the "pre-wash mode, the main wash mode, and the post-wash mode." Therefore, the portion of the water discharge ports 474 of the nozzle 473 is washed by the warm water that the water discharge ports 474 themselves discharge.

The control unit 405 closes the solenoid valve 431 and switches the flow rate switch valve 471 and the flow channel switch valve 472 from "SC" to the "origin" (timing t214). Also, the control unit 405 performs a setting modification of the warm water heater 441 from the "pre-wash mode, the main wash mode, and the post-wash mode" to a "temperature maintenance control mode" (timing t214).

Continuing, when a prescribed amount of time (here, for example, about 25 seconds) has elapsed after the user appropriately performs the "bottom dry" and rises from the toilet seat 200 (timing t215), the control unit 405 switches the flow rate switch valve 471 and the flow channel switch valve 472 from the "origin" to "SC" and makes it possible to discharge from all of the water discharge ports 474 for the "bottom wash" and the "bidet wash" (timing t216). Further, the control unit 405 opens the solenoid valve 431 (timing t216).

Then, the control unit 405 starts the flow of current to the electrolytic cell unit 450 (timing t217). Further, the control unit 405 performs a setting modification of the warm water heater 441 from an "anti-freeze mode" to a "heater current prohibition mode" (timing t217). That is, the control unit 405 stops the flow of current to the warm water heater 441. Thereby, the "pre-sterilization" of the water discharge port 474 is executed.

Here, after the control unit 405 opens the solenoid valve 431 (timing t216), the control unit 405 starts the flow of current to the electrolytic cell unit 450 (timing t217). Therefore, even in the case where there is warm water inside the electrolytic cell unit 450, the warm water is discharged and replaced with water that is unheated. That is, the control unit 405 can start the flow of current to the electrolytic cell unit 450 after discharging the warm water of the electrolytic cell unit 450 and replacing the warm water of the electrolytic cell unit 450 with water that is unheated. Thereby, the electrolysis of the warm water can be suppressed; and the increase of the production of the scale can be suppressed.

Because the control unit 405 starts the flow of current to the electrolytic cell unit 450 after the control unit 405 opens the solenoid valve 431, the flow of current in the state in which there is no water between the electrodes of the electrolytic cell unit 450 can be prevented. Thereby, a local flow of current in the anode plate 454 and the cathode plate 455 can be prevented; and a decrease of the life of the anode plate 454 and the cathode plate 455 can be suppressed.

Continuing, the control unit 405 switches the flow rate switch valve 471 and the flow channel switch valve 472 from "SC" to the "origin" (timing t218). Then, the control unit 405 causes the nozzle 473 stored in the casing 400 to advance to the position of "full advancement" (timing t219 to t220). At this time, the central body of the nozzle 473 is sterilized by the sterilizing water squirted from the water discharge unit 479 because the solenoid valve 431 is opened by the control unit 405 and the control unit 405 provides the current to the electrolytic cell unit 450. Continuing, the control unit 405 stores the nozzle 473, which had advanced to the position of "full advancement," in the casing 400 (timing t220 to t221). At this time as well, the central body of the nozzle 473 is sterilized by the sterilizing water squirted from the water discharge unit 479 because the solenoid valve 431 is opened by the control unit 405 and the control unit 405 provides the current to the electrolytic cell unit 450.

Continuing, the control unit 405 switches the flow rate switch valve 471 and the flow channel switch valve 472 from the "origin" to "SC" and makes it possible to discharge from all of the water discharge ports 474 for the "bottom wash" and the "bidet wash" (timing t221). Thereby, the "post-sterilization" of the water discharge ports 474 is executed.

Then, the control unit 405 stops the flow of current to the electrolytic cell unit 450 and performs a setting modification of the warm water heater 441 from the "heater current prohibition mode" to the "anti-freeze mode" (timing t222). Further, the control unit 405 closes the solenoid valve 431 and switches the flow rate switch valve 471 and the flow channel switch valve 472 from "SC" to the "origin" (timing t222).

Continuing, after a prescribed amount of time (here, for example, about 8 hours) has elapsed from when the sanitary washing apparatus 100 was used last, the control unit 405 switches the flow rate switch valve 471 and the flow channel switch valve 472 from the "origin" to "SC" and makes it possible to discharge from all of the water discharge ports 474 for the "bottom wash" and the "bidet wash" (timing t223). Further, the control unit 405 opens the solenoid valve 431 (timing t223). Subsequently, the control unit 405 starts the flow of current to the electrolytic cell unit 450 (timing t224). Thereby, a regular sterilization of the interior of the flow channel 20 and the water discharge ports 474 is executed.

Then, the control unit 405 stops the flow of current to the electrolytic cell unit 450 (timing t225). Further, the control unit 405 closes the solenoid valve 431 and switches the flow rate switch valve 471 and the flow channel switch valve 472 from "SC" to the "origin" (timing t225).

In this specific example, although the control unit 405 performs the setting modification of the warm water heater 441 from the "anti-freeze mode" to the "heater current prohibition mode" when performing the "pre-sterilization" (timing t217), this is not limited only thereto. The control unit 405 may set the warm water heater 441 to remain at the "anti-freeze mode" when performing the "pre-sterilization." That is, the control unit 405 may set the warm water heater 441 to remain at the "anti-freeze mode" at timing t217 to t222.

In such a case, the control unit 405 increases the water temperature by providing the current to the warm water heater 441 (an ON/OFF control of the warm water heater 441) when the water temperature becomes a prescribed temperature (e.g., about 6° C.) or less. Here, the current amount for preventing freezing is a current amount such that the temperature of the water heated by the warm water heater 441 is a temperature that is lower than the set value of the warm water temperature when executing the body wash. Therefore, in such a case as well, the increase of the production of the scale can be suppressed. In districts other than cold districts, the state of the warm water heater 441 is substantially similar to the stopped state even when set to the "anti-freeze mode."

On the other hand, in the specific example shown in FIG. 11, the control unit 405 performs the setting modification of the warm water heater 441 from the "anti-freeze mode" to the "heater current prohibition mode" when performing the "pre-sterilization" (timing t217). That is, the control unit 405 stops the flow of current to the warm water heater 441 when performing the "pre-sterilization." In such a case, although the control unit 405 does not provide the current to the warm water heater 441 even in the case where the water temperature becomes the prescribed temperature (e.g., about 6° C.) or less, there is little risk of the water freezing because the solenoid valve 431 is opened and the water flows through the flow channel 20.

As described above, according to the embodiment, the control unit 405 stops the flow of current to the warm water heater 441 or reduces the current amount to the warm water heater 441 when starting the flow of current to the electrolytic cell unit 450, causing the electrolytic cell unit 450 to produce the sterilizing water, and sterilizing the nozzle 473. Therefore, when the control unit 405 starts the flow of current to the electrolytic cell unit 450, the water inside the electrolytic cell unit 450 is water that is unheated. Or, when the control unit 405 starts the flow of current to the electrolytic cell unit 450, the warm water inside the electrolytic cell unit 450 is replaced with water that is unheated. Thereby, the increase of the production of the scale can be suppressed.

Hereinabove, embodiments of the invention are described. However, the invention is not limited to these descriptions. Appropriate design modifications made by one skilled in the art in regard to the embodiments described above also are within the scope of the invention to the extent that the features of the invention are included. For example, the configurations, the dimensions, the material properties, the dispositions, etc., of components included in the sanitary washing apparatus 100 and the like, the disposition methods of the nozzle 473 and the nozzle wash chamber 478, etc., are not limited to those illustrated and may be modified appropriately. The prescribed amount of time (e.g., about 25 seconds as described above in regard to FIG. 4 and FIG. 11) from when the seat contact detection sensor 404 no longer detects the user seated on the toilet seat 200 to when the control unit 405 starts the flow of current to the electrolytic cell unit 450 may be modified appropriately. Further, the prescribed amount of time (e.g., about 8 hours as described above in regard to FIG. 4 and FIG. 11) from when the sanitary washing apparatus 100 was used last to when the control unit 405 executes the regular sterilization may be modified appropriately. Although it is desirable for the discharge timing of the dedicated nozzle that discharges the sterilizing water into the bowl 801 to be after the toilet washing, this can be modified appropriately.

The components included in the embodiments described above can be combined within the extent of technical feasibility; and such combinations are included in the scope of the invention to the extent that the features of the invention are included.

Industrial Applicability

According to the invention, a sanitary washing apparatus that can suppress clogging of the flow channel due to scale is provided.

Reference Signs List

10 water supply source
20 flow channel
100 sanitary washing apparatus
200 toilet seat
300 toilet lid
310 transmissive window
400 casing
401 power supply circuit
402 room entrance detection sensor
403 human body detection sensor
404 seat contact detection sensor
405 control unit
407 exhaust port
408 outlet
409 recessed portion
431 solenoid valve
440 heat exchanger unit
441 warm water heater
450 electrolytic cell unit
450*a* outlet unit
454 anode plate
455 cathode plate
460 pressure modulation device
470 nozzle unit
471 flow rate switch valve
472 flow channel switch valve
473 nozzle
474 water discharge port
475 mount
476 nozzle motor
477 transmission member
478 nozzle wash chamber
479 water discharge unit
500 operation unit
600 reference numeral
600*a* connection portion
800 western-style sit-down toilet
801 bowl
S strainer
C tube

The invention claimed is:

1. A sanitary washing apparatus, characterized by:

a nozzle having a water discharge port, the nozzle being configured to wash a body of a user by squirting water from the water discharge port;

a flow channel configured to guide water supplied from a water supply source toward the water discharge port;

an electrolytic cell provided at an intermediate portion of the flow channel, the electrolytic cell being capable of producing sterilizing water; and a nozzle wash unit configured to wash or sterilize the nozzle with the sterilizing water produced by the electrolytic cell, a contraction portion being formed downstream from the electrolytic cell, a flow channel cross-sectional area being smaller at the contraction portion than upstream from the electrolytic cell, a strainer being disposed in the flow channel further downstream from the contraction portion.

2. A sanitary washing apparatus, characterized by:

a nozzle disposed at a toilet upper portion, the nozzle having a water discharge port, the nozzle being configured to discharge water from the water discharge port toward a bowl face of the toilet;

a flow channel configured to guide water supplied from a water supply source toward the water discharge port;

an electrolytic cell provided at an intermediate portion of the flow channel, the electrolytic cell being capable of producing sterilizing water; and a bowl wash unit configured to wash or sterilize the bowl face with the sterilizing water produced by the electrolytic cell, a contraction portion being formed downstream from the electrolytic cell, a flow channel cross-sectional area being smaller at the contraction portion than upstream from the electrolytic cell, a strainer being disposed in the flow channel further downstream from the contraction portion.

3. The sanitary washing apparatus according to claim 1, wherein the contraction portion is formed a prescribed spacing from an outlet unit of the electrolytic cell.

4. The sanitary washing apparatus according to claim 2, wherein the contraction portion is formed a prescribed spacing from an outlet unit of the electrolytic cell.

5. The sanitary washing apparatus according to claim 1, wherein the flow channel on an outlet side of the electrolytic cell is an outlet unit, a diameter of the flow channel being greater at the outlet unit than upstream from the electrolytic cell.

6. The sanitary washing apparatus according to claim 2, wherein the flow channel on an outlet side of the electrolytic cell is an outlet unit, a diameter of the flow channel being greater at the outlet unit than upstream from the electrolytic cell.

7. The sanitary washing apparatus according to claim 1, wherein the strainer is provided attachably and removably.

8. The sanitary washing apparatus according to claim 2, wherein the strainer is provided attachably and removably.

9. The sanitary washing apparatus according to claim 1, wherein the strainer is formed of a material having a low surface energy.

10. The sanitary washing apparatus according to claim 2, wherein the strainer is formed of a material having a low surface energy.

11. The sanitary washing apparatus according to claim 9, wherein the strainer is fixed to a fixing portion of the flow channel, and a surface energy of the fixing portion is greater than the surface energy of the strainer.

12. The sanitary washing apparatus according to claim 10, wherein the strainer is fixed to a fixing portion of the flow channel, and a surface energy of the fixing portion is greater than the surface energy of the strainer.

13. The sanitary washing apparatus according to claim 1, wherein the strainer has a mesh configuration capable of passing particles having no risk of clogging the flow channel downstream.

14. The sanitary washing apparatus according to claim 2, wherein the strainer has a mesh configuration capable of passing particles having no risk of clogging the flow channel downstream.

* * * * *

UNITED STATES PATENT AND TRADEMARK OFFICE

CERTIFICATE OF CORRECTION

PATENT NO. : 8,856,979 B2
APPLICATION NO. : 13/812234
DATED : October 14, 2014
INVENTOR(S) : Satoru Matsumoto et al.

It is certified that error appears in the above-identified patent and that said Letters Patent is hereby corrected as shown below:

In The Specification

Column 3, line 7; Please delete "tinning" and add -- timing --

Column 10, line 25; Please delete "U01" and add -- t101 --

Column 14, line 66; Please delete "(Oft)" and add -- ($OH^-$) --

Column 15, line 1; Please delete "$Cl_2 + H_2O \rightarrow HClO + H^+ + H^+ + Cl^-$" and add
-- $Cl_2 + H_2O \rightarrow HClO + H^+ + Cl^-$ --

Signed and Sealed this
Fifth Day of May, 2015

Michelle K. Lee

Michelle K. Lee
*Director of the United States Patent and Trademark Office*